US006962327B2

(12) United States Patent
Reid

(10) Patent No.: US 6,962,327 B2
(45) Date of Patent: Nov. 8, 2005

(54) FENCE SUPPORT

(75) Inventor: Paul Clifford Reid, Hamilton (NZ)

(73) Assignee: Gallagher Group Limited, Hamilton (NZ)

( * ) Notice: Subject to any disclaimer, the term of this patent is extended or adjusted under 35 U.S.C. 154(b) by 0 days.

(21) Appl. No.: 10/044,721

(22) Filed: Jan. 14, 2002

(65) Prior Publication Data

US 2002/0125466 A1 Sep. 12, 2002

Related U.S. Application Data

(63) Continuation of application No. PCT/NZ00/00104, filed on Jun. 20, 2000.

(51) Int. Cl.[7] ..... E04H 17/04
(52) U.S. Cl. ..... 256/1; 256/19
(58) Field of Search ..... 256/1, 19, 59, 256/65.01, 65.02

(56) References Cited

U.S. PATENT DOCUMENTS

| | | | | |
|---|---|---|---|---|
| 1,773,519 | A | 8/1930 | Cox | |
| 2,161,944 | A | 6/1939 | Bauer | |
| 3,028,147 | A | 4/1962 | Crumbo | |
| 3,749,368 | A | 7/1973 | Miller | |
| 3,776,522 | A | 12/1973 | Bartlett | |
| 4,065,103 | A | 12/1977 | Sweezey | |
| 4,159,820 | A | 7/1979 | Parisien | |
| 4,520,231 | A | 5/1985 | Hubbell | |
| 4,680,428 | A | 7/1987 | Wilson, Jr. | |
| 5,662,313 | A | 9/1997 | Forrester | |
| 6,045,099 | A | 4/2000 | Aiken et al. | |
| 6,330,998 | B1 * | 12/2001 | Roy | 256/19 |

* cited by examiner

*Primary Examiner*—John R. Cottingham
(74) *Attorney, Agent, or Firm*—Lowe Hauptman & Berner, LLP

(57) ABSTRACT

A fence device and method for constructing a fence support which comprises a sleeve for over a supporting member such as a rod extending vertically from a concrete base. The sleeve can be constructed of extruded insulating material and includes deformable internal projections to secure the sleeve by friction to the supporting member. The sleeve comprises at least one web or flange extending longitudinally and normally therefrom which has slots or incisions therein for a supporting lengths of material such as electrified wires. In one embodiment a pair of slots are disposed at opposing angles to facilitate securing lengths of wire.

6 Claims, 4 Drawing Sheets

FENCE SUPPORT

This is a continuation of application No. PCT/N200/00104, Jun. 20, 2000.

FIELD OF THE INVENTION

This invention relates to an improved fence support.

BACKGROUND OF THE INVENTION

Reference throughout this specification shall be mainly made to use of the present invention with electrified fences. However, it will be appreciated that the present invention can have application to non-electrified fences as well.

Insulators for wires conducting an electrical current are sometimes manufactured separately from the main support wire, and attached to the support as required.

Security systems employing wall-top fencing are usually installed by attaching insulators to support rods atop the wall.

This process can be labor intensive and time consuming. Further, the insulators and the rods often lack aesthetic appeal.

The aesthetic quality of the insulators is important as wall-top security fencing is commonly employed in the domestic market. Thus, the main support for the insulator and electric fence needs to be configured for both appearance and its ability to support and insulate the fence wires.

The process of erecting both posts and insulators can therefore be time consuming and labor intensive as dedicated supports having aesthetic qualities and providing support can be more difficult to install than basic supports such as reinforcing rods.

It is an object of the present invention to address the foregoing problems or at least to provide the public with a useful choice.

Further aspects and advantages of the present invention will become apparent from the ensuing description which is given by way of example only.

SUMMARY OF THE INVENTION

The object of the instant invention is to provide a method of construction of a fence support for a fence, characterized by the step of fitting a sleeve over an upright support, the sleeve having at least one web being configured to support lengths of material used in the fence.

According to a further aspect of the present invention there is provided a method of adapting a fence support, characterized by the step of fitting a sleeve over the support, the sleeve having at least one web configured to support lengths of material used in the fence.

According to a further aspect of the present invention there is provided a sleeve configured to fit over a support member for a fence, characterized in that the sleeve has at least one web configured to support lengths of material used in the fence.

Reference to a support may be made with reference to a structure configured to support an electric fence arrangement in a desired manner.

Therefore, in preferred embodiments, the sleeve is made from an insulating material, such as plastics.

For example, the support may be a post, rod, beam, pile, block and so forth.

In preferred embodiments the upright support may be a rod.

In some embodiments, the rod may be a stranded reinforcing rod, such as that commonly used in constructions of reinforced concrete.

References to a rod should not be seen to be limiting as other supports may be used in accordance with the present invention.

The length of material used in the fence shall now be referred to as wire. However, wire should be understood as generic term. For example, the wire may include a length of metal wire, electric fence tape, electric braid, mixed metal conductive lengths, and so forth.

In some embodiments, the sleeve may surround the support fully. In other embodiments, the sleeve may only partially extend around the support, for example three-quarters or so. An important factor is that the sleeve surrounds the support sufficiently to be retained in position. In some embodiments, the sleeve may be circular in cross section and have a split along its length.

The sleeve may be formed by a number of ways. However, in preferred embodiments the sleeve is extruded as this is most cost effective for producing a length of material having a substantially continuous cross section.

The relative thicknesses of the sleeve and the web may vary and in preferred embodiments the sleeve is of greater thickness than the web in so as to ensure sufficient strength in the sleeve while saving on material in the web.

Reference throughout this specification shall now be made to the sleeve as being extruded.

The sleeve may have internal projections providing a frictional fit between the sleeve and the rod.

In some embodiments the projections may be deformable.

The advantage of deformable projections may be that the sleeve may fit rods of variable diameter.

However, reference to projections should not be seen to be limiting. A frictional fit between the support and the sleeve may equally be achieved between the rod and the internal wall of the sleeve.

The term web is envisaged as being a flange or some other projection extending outwardly from the main body of the sleeve. In some embodiments the web may be continuous along the length of the sleeve.

In other embodiments, there may be a number of webs extending outwardly from the sleeve along the length of the sleeve. For example, the sleeve may be made via an extrusion process initially with a continuous web along the length of the sleeve. Subsequently to be extruded, that web may have portions cut therefrom in order that the webs can support the wires of the fence.

In other embodiments the web may be spaced along the length of the sleeve.

In some embodiments, the web may have slots for retaining the electric fence wire. The slots may in some embodiments be hook shaped and configured to retain the wire against natural movement of the wire, say by wind.

The number of webs provided may vary accordingly to necessity.

In some embodiments, there may be two webs, with oppositely angled slots, for retaining the electric fence wire.

In other embodiments there may be a single web, although this should not be understood to be limiting.

In some embodiments the sleeve may have detents at set lengths.

This may enable standard size lengths to be cut.

Therefore if the standard lengths are placed along side each other, the wire holding means will be substantially aligned, providing a uniformly formed electric fence.

In some embodiments, the sleeve may have conductive areas imbedded in the molding for various purposes.

In preferred embodiments, the sleeve may be manufactured from a substantially rigid material.

For example, this may include plastic, metal, Kevlar, ceramics, glass and so forth.

Preferably, the rigidity of the material may be such that it may withstand blows from a hammer to place the sleeve over the rod.

At least part of the sleeve may be manufactured from an electrically insulating material, such that the web or the wire supports are insulated.

The sleeve may also include a cap configured to attach the top of the sleeve. Alternatively there may be supplied a cap that fits onto the rod held within the sleeve.

In preferred embodiments, the cap may be configured positively to lock the sleeve to the support.

On advantage of the cap may be to reduce the ability of intruders to remove the sleeve from the support and breach the electric fence.

The cap may have fingers that insert into the sleeve and lock it into position on the support.

The cap may preferably be waterproof.

This has an advantage that mild steel or other cheaper materials with less resistance to corrosion may be used in the support because the cap will prevent or greatly minimize the amount of moisture that will come in contact with the support, and therefore reducing the risk of moisture corrosion.

The cap also improves the aesthetic appeal of the sleeve.

A further advantage of having the cap is in the actual physical construction of the fence.

Fence made in accordance with the present invention are envisaged to be fairly rugged. Thus, it is envisaged that in constructing the fence, the sleeve and cap are placed over the rod and then hammered into position quite vigorously. The hammering may be sufficient to force the cap to be secured in place with respect to the sleeve and the rod, thus not requiring any other means of fixing the cap such as adhesives and the like.

The present invention may have provision for advertising and promotional printing space on the sleeve. This may be included on the web.

In some embodiments of the present invention, the fence may be constructed as previously described, but then the rods are subsequently removed from the sleeves to provide a less expensive fence, even if less secure. For example, the present invention could be used to construct a pet enclosure or to exclude predators by hammering the sleeve and rod into the ground and then subsequently removing the rod once the sleeve is secured.

The present invention provides a number of potential advantages.

The present invention provides a simple, cost effective and less time consuming method and apparatus for providing an electric fence wire support, with improved aesthetic appeal.

Whereas previously, dedicated supports were required to be erected with insulators attached in a separate process, the present invention allows simple cheap main supports to be used for the electric fence support, without compromising aesthetic appeal, with the easily installed sleeve fitting over the support having an integrally formed provision for an insulated wire support.

BRIEF DESCRIPTION OF THE DRAWINGS

Further aspects of the present invention will become apparent from the following description which is given by way of example only and with reference to the accompanying drawings in which.

DETAILED DESCRIPTION OF THE PREFERRED EMBODIMENTS OF THE INVENTION

Figure 1:
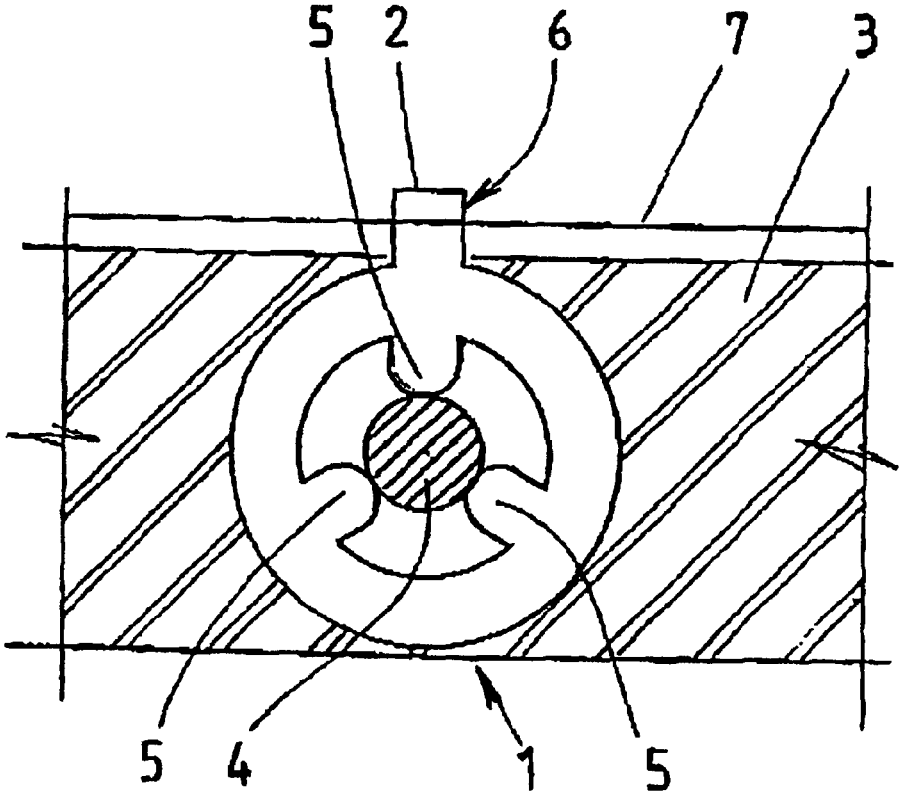
FIG. 1 shows a cross-sectional view of one embodiment of the present invention.

According to FIG. 1 there is shown a plan view of one embodiment of the present invention.

A sleeve 1 is substantially cylindrical, but includes a web 2 formed on the exterior of the cylindrical section. Sleeve 1 is mounted a top a wall 3, and has been slid over a rod 4 which is in turn embedded or otherwise fixably attached to the wall top 3.

It is envisaged that sleeve 1 may be hammered or forced over rod 4 to provide a tight frictional fit.

In order to allow for variable rod diameters, projections 5 are formed on the inside of the sleeve projecting towards the center. These projections 5 may be deformable to a degree, to provide a tight frictional fit between the projections and the rod 4 whilst the deformability allows for variations in rod diameter.

Web 2 includes incisions, indicated by arrow 6 along the length of the web, the incisions configured to receive electric fence wire length 7.

Sleeve 1 is preferably manufactured from an insulating material such as plastic. However, the sleeve will meet the objects of the present invention as long as the web or the web/wire 7 contact point/incisions 6 is electrically insulated.

Sleeve 1 may be manufactured from other insulating materials such as glass, wood, Kevlar and so forth.

Figure 2:
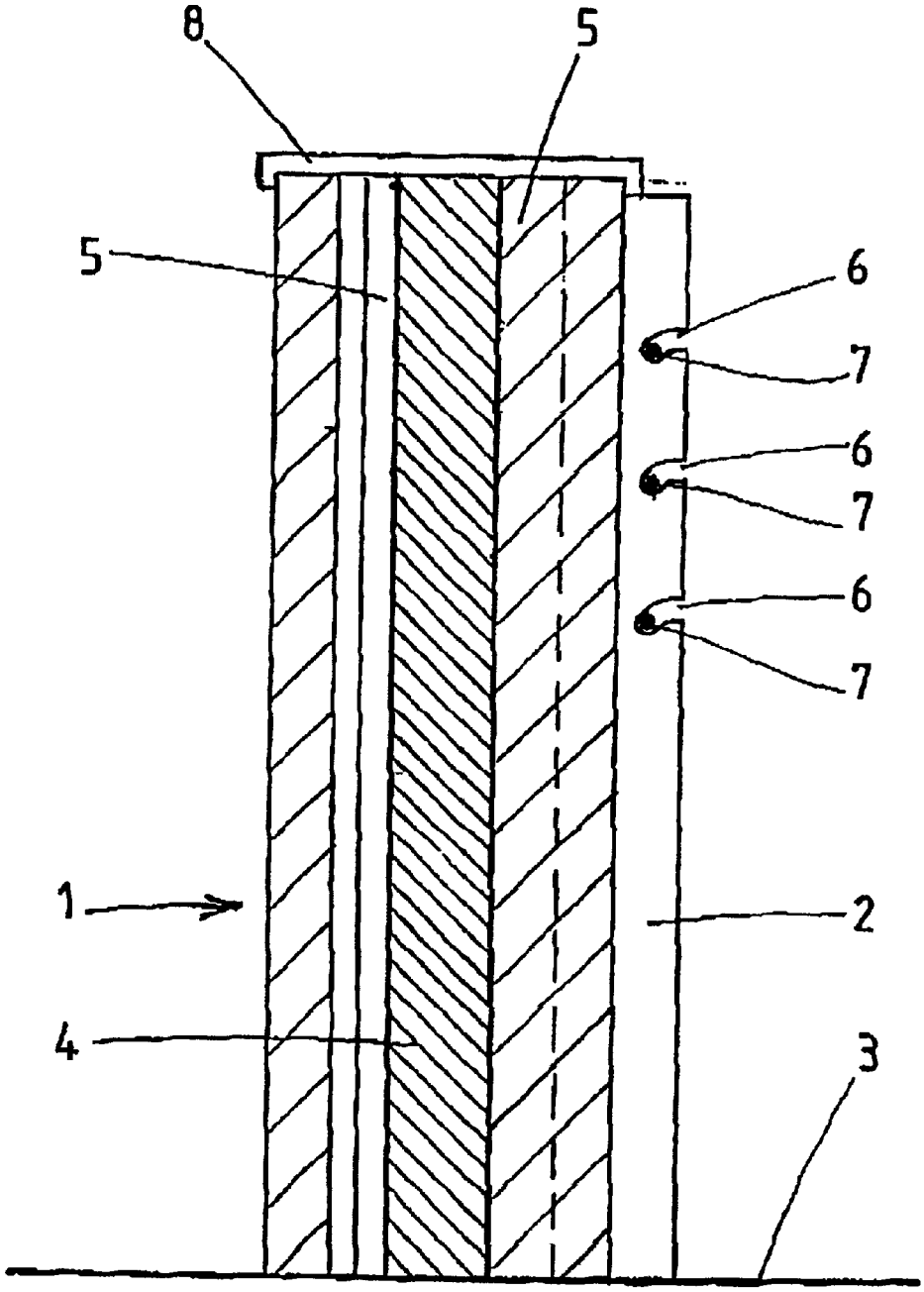
FIG. 2 shows a side-on cross-sectional view of a preferred embodiment of the present invention attached to a support.

With reference to FIG. 2, there is shown an elevational cross-sectional view of the sleeve shown in FIG. 1. Rod 4 is fixably attached to a well 3. Sleeve 1 is slid over rod 4, the frictional fit being provided between rod 4 and projections 5 on the interior of the sleeve 1.

Incisions 6 are better shown in web 2 and retain electric fence wire 7, which is shown passing through the page.

Also provided is a cap 8 which may seal the open top of sleeve 1.

Cap 8 may also have projecting fingers, that are configured positively to lock cap 8, rod 4 and sleeve 1 together. This reduces the ability of a potential intruder to remove sleeve 1 from rod 4, thereby breaching the security provided by the electric fence wires 7.

Cap 8 also improves aesthetic appeal and prevents or greatly minimizes the amount of water or moisture accumulation within sleeve 1 potentially preventing or greatly reducing the corrosive effects of moisture on rod 4.

Therefore, cheaper materials may be used in the manufacture of rod 4, reducing the overall cost of providing the electric fence support.

It can be seen from the plan view of FIG. 1 that the substantially cross-sectional uniform shape of sleeve 1 enables the sleeve to be manufactured by extrusions.

Figure 3:
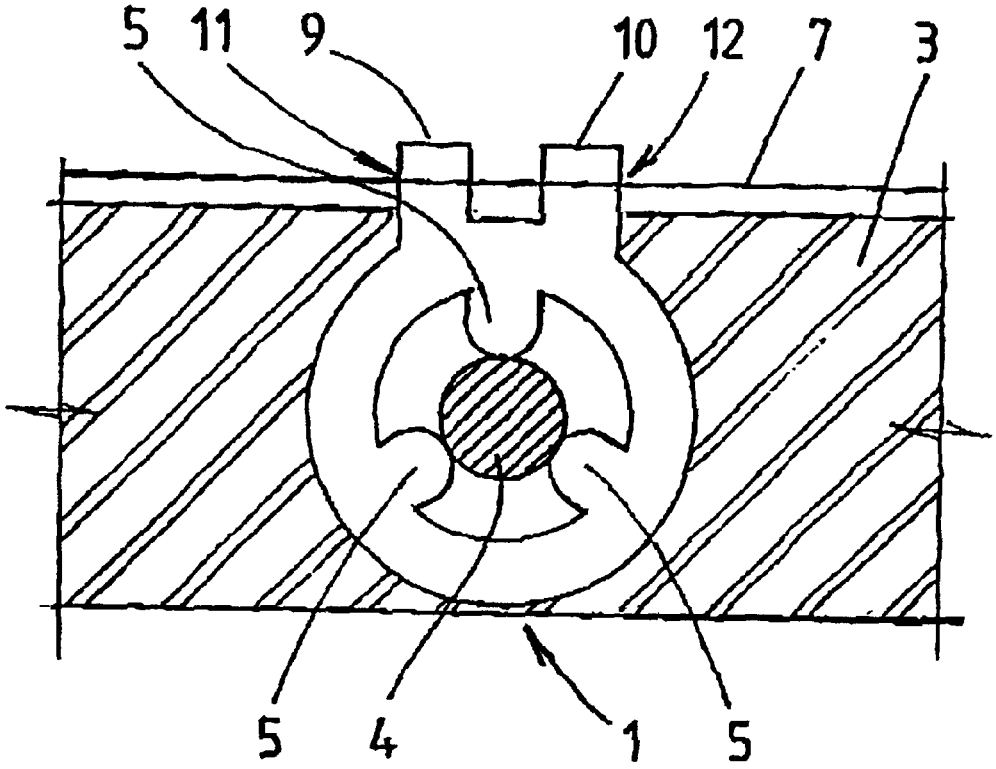
FIG. 3 shows a further embodiment, having two webs.
Figure 4:
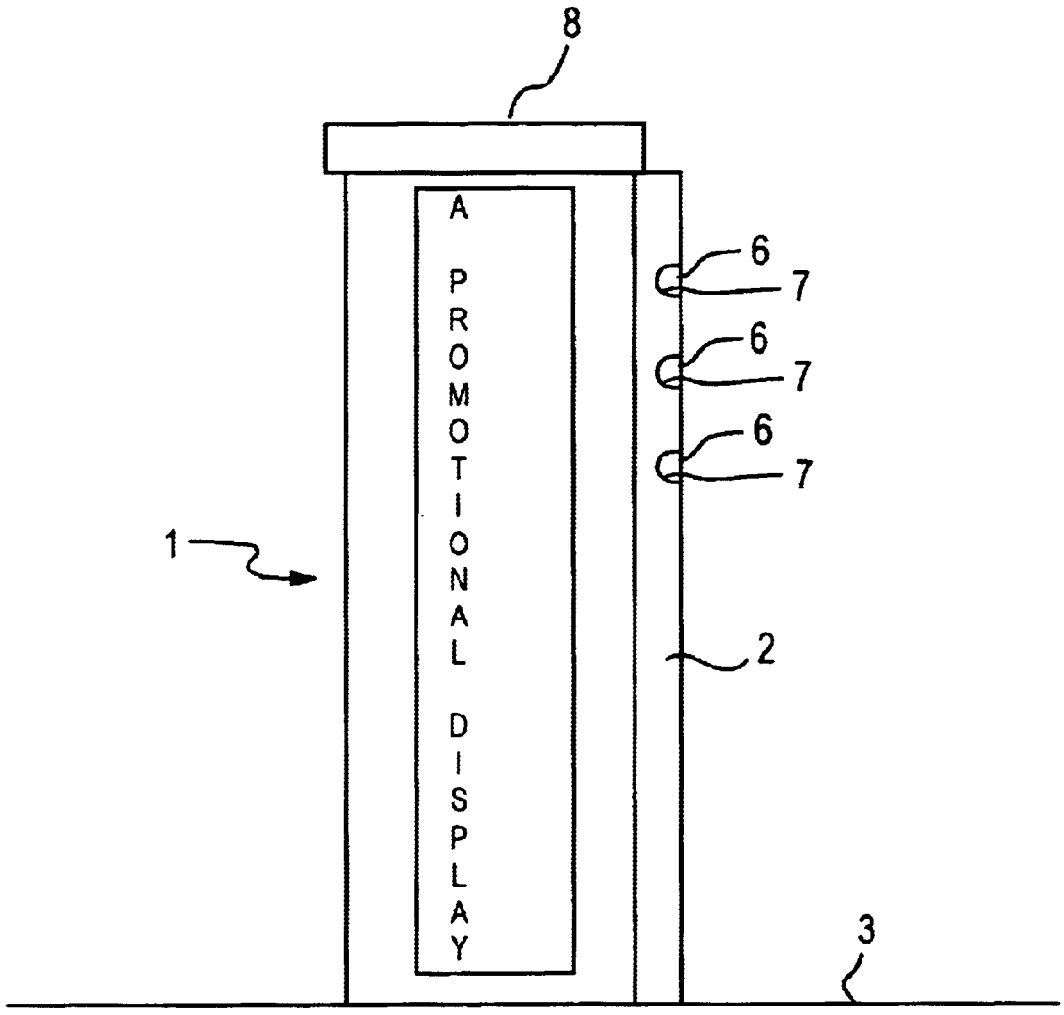
FIG. 4 illustrates a promotional display on an embodiment of the invention.

With reference to FIG. 3 there is shown a plan view with a further embodiment of the present invention. The numbered features on FIG. 3 are the same as for FIGS. 1 and 2, except that web 2 is replaced with two webs 9 and 10. Webs 9 and 10 work in concert with each other to retain the electric wire 7. Webs 9 and 10 include slots 11 and 12, respectively, which may be cut at opposing angles to work in concert to retain electric wire 7 in position on sleeve 1.

The term "sleeve" as used in the claims refers to a structure that is open at both ends and does not include a cap, as such.

Aspects of the present invention have been disclosed by way of example only and it should be appreciated that modifications and additions may be made thereto without departing from the scope of the appended claims.

What is claimed is:

1. A structure for an electrified fence, said structure comprising a sleeve that receives and substantially surrounds the entire exposed surface of a post which extends vertically from the underlying surface at the site of the electrified fence, the interior of said sleeve comprising three internal projections for frictionally and forcibly receiving the post, each projection being equidistant from the other two projections, said sleeve further including an exterior web which is disposed parallel to the post with said sleeve installed over said post, said web having an opening for receiving an electrified wire of the fence, said sleeve being composed of dielectric material at least where said sleeve receives the electrified wire; and a cap separate from said sleeve and covering the top of the post with said sleeve is installed over the post.

2. The structure of claim 1, wherein said opening comprises a plurality of longitudinally spaced slots formed in the web for supporting electrified wires of the electric fence.

3. The structure of claim 2, wherein each of said slots extends from an open mouth in an outer face of the web through which the respective wire is received, to a closed end for abutting the wire in use, the closed end being positioned below the mouth of the slot when the sleeve is upright.

4. The structure of claim 3, wherein the slots are substantially parallel and curved.

5. The structure of claim 1, wherein the three internal projections are elongate and substantially coextensive with the sleeve.

6. The structure of claim 1, wherein the sleeve is substantially cylindrical.

* * * * *